United States Patent [19]

Resh

[11] Patent Number: 4,849,584

[45] Date of Patent: Jul. 18, 1989

[54] HIGH VOLTAGE SWITCH ASSEMBLY

[75] Inventor: John Resh, Valparaiso, Ind.

[73] Assignee: McGill Manufacturing Company, Valparaiso, Ind.

[21] Appl. No.: 221,100

[22] Filed: Jul. 19, 1988

[51] Int. Cl.[4] ..... H01H 19/00; H01H 21/00

[52] U.S. Cl. ..... 200/6 R; 200/11 R; 200/43.16; 200/276; 200/325; 200/566

[58] Field of Search ..... 200/5 R, 5 E, 6 R, 11 R, 200/11 E, 11 EA, 11 G, 11 K, 11 TC, 17 R, 276, 276.1, 564, 566, 43.16, 325

[56] References Cited

U.S. PATENT DOCUMENTS 2,835,754 5/1958 Lewis ..... 200/6 R X

*Primary Examiner*—J. R. Scott

*Attorney, Agent, or Firm*—Leydig, Voit & Mayer

[57] ABSTRACT

A high-voltage switching device is provided having an insulating base member mounted to a panel such that a wiper arm assembly of the switching device is accessible from the front of the panel for pivoting a switching member between open and closed positions. Preferably, the switching member is a conductive rod having a portion coiled about a primary terminal assembly of the switch such that a first end of the conductive rod may be pivoted about the axis of the coiled portion between the open and closed positions. Although the switch is intended for high-voltage applications, the conductive rod is of sufficiently small gauge so as to allow for the manual pivoting of the rod without the need of leveraging linkages. The insulating base member of the switching device provides effective electronic isolation of the terminal assemblies and the conductive rod from one another and from the ambient environment of the switch such that a protective insulating housing is unnecessary.

15 Claims, 2 Drawing Sheets

HIGH VOLTAGE SWITCH ASSEMBLY

FIELD OF THE INVENTION

The present invention relates generally to electric switch assemblies, and more particularly, to electric switch assemblies which are suitable for use in a high-voltage circuit.

BACKGROUND OF THE INVENTION

It is well known to utilize electric switching devices for controlling the application of a power source to a circuit. Typically, such switching devices are operated when the system incorporating the switching device is operating and power is present at the switching terminals. When the applied voltage is of high magnitude, the switching device must be designed to prevent arcing and its damaging effects. Consequently, many elaborate schemes have been developed to ensure that destructive arcing does not occur when contact is broken or made at a switching terminal. However, when placed in environments that require switching only when power is removed from the terminals, these prior art switching devices are needlessly complex and expensive, and thus are totally inappropriate. If these environments are in highly competitive commercial markets where price is a crucial factor, the manufacturing cost of the switching device is a very important consideration.

In view of the foregoing, there is a need for a simplified switching device for use in a high-voltage environment that does not require switching to occur while power is applied.

OBJECTS AND SUMMARY OF THE INVENTION

It is an object of the present invention to provide a relatively inexpensive electric switch assembly for use in a high-voltage environment.

In this connection, it is a related object to provide a high-voltage electric switch assembly which is relatively simple in design and lends itself to economical manufacture and ease of use.

Another object of the invention is to provide an electric switch assembly of the foregoing type which is relatively lightweight and durable.

Yet another object of the invention is to provide an electric switch assembly of the foregoing type which may be manually actuated without exposing the operator to dangerously high voltages.

The foregoing objects are achieved in a switch assembly according to the present invention by the provision of an insulating base member carrying primary and secondary conductive terminal assemblies in a manner that electrically isolates a high voltage at one terminal assembly from the other terminal assembly and from conductive surfaces in the ambient environment of the switch. The electrical isolation of the high voltages is accomplished without the necessity of a housing which insulates the terminal assemblies from the ambient environment, thereby greatly simplifying the switch assembly and enabling its inexpensive manufacture.

To provide a conductive path between the primary and secondary terminal assemblies, a conductive rod is mounted to pivot about one of the terminal assemblies. Pivoting of the conductive rod alternately connects and disconnects the primary and secondary terminal assemblies, thereby providing the switching function. To provide for such pivotal movement, a conductive rod is coiled about the primary terminal assembly, with a first end diverging from a coiled path and extending radially outwardly from an axis of the coil formed by the rod. This radial extension of the rod is sufficiently long such that the pivoting of the extension about the axis of the coil causes the first end of the rod to contact the secondary terminal assembly.

To define the alternative states of the switch assembly, a second end of the conductive rod diverges from the coiled path to form a radially extending leg which is in fixed relationship with the primary terminal assembly such that the pivoting of the first end of the conductive rod toward the secondary terminal assembly creates a torsional force which tends to bias the rod away from that assembly. In order for the first end of the rod to maintain contact with the secondary terminal assembly, a locking mechanism is provided which makes use of the torsional force in order to maintain positive electrical contact between the first end and the secondary terminal assembly. With the first end of the rod in positive electrical contact with the secondary terminal assembly, the conductive rod provides a low-resistance path for the high voltage to travel between the terminal assemblies.

Because the switch assembly is intended for high-voltage and low-current applications, the gauge of the conductive rod may be of sufficiently small diameter so that the torsional force imparted by the pivotal movement of the first end of the rod about the axis of the coil of the rod can be easily overcome by the force applied by a human hand. Therefore, the switch assembly according to the invention does not require sophisticated leverage devices in order to change the electrical state of the switch. Furthermore, because the switch assembly is intended to be operated only when power is not present at the terminal assemblies, destructive arcing is not a design consideration. To maximize manufacturing ease and provide the least expensive switch assembly possible, the base member is a monolithic block preferably made of a polymer having excellent insulating properties and formed by injection molding. The rod and primary and secondary terminal assemblies on the monolithic block are in a spaced relationship from one another and from ambient conductive surfaces which ensures air ionization and electrical arcing do not occur.

When unlocked from positive engagement with the secondary terminal assembly, the first end of the rod responds to the torsional force exerted by the coil of the rod by moving along an arcuate path about the axis of the coil. In order to define a resting position for the first end of the rod when released from the secondary terminal and also to provide additional insulating protection from the ambient environment, the terminal assemblies and conductive rod are mounted in a recessed area of the base member. The shape and extent of the recess is defined by the area of the monolithic block over which the first end of the rod sweeps as it travels from the secondary terminal assembly to its resting place. A wall of the recess provides a surface which interrupts the pivoting of the rod so as to define the resting position of the rod. Because the rod and terminal assemblies are seated in a recess of the monolithic block, they are insulated by the block material from other possible conductors except for those conductors which may be directly over or in front of the recess. For these latter conductors, the depth of the recess successfully spaces the terminals and rod such that sufficient air space exists between any conductive surface in the ambient environment to prevent air ionization and resulting arcing. Therefore, the switch of the invention does not require an expensive insulating housing.

To pivot the rod while maintaining sufficient distance from it and any conductive surface including human skin, an arcuate slot is provided in the monolithic block which receives a wiper arm assembly of insulating material. The handle member of the wiper arm assembly is secured at its one end to the rod extension and extends through the slot of the block such that the second end of the handle member may be grabbed and manually directed along the arcuate length of the slot by overcoming the torsional force from the coiled portion of the rod.

BRIEF DESCRIPTION OF THE DRAWINGS

For the purpose of facilitating an understanding of the invention, the accompanying drawings illustrate a preferred embodiment. The above and other objects of the invention, as well as the features thereof as summarized above, will become more apparent from the following description when taken in conjunction with the accompanying drawings.

DETAILED DESCRIPTION OF THE PREFERRED EMBODIMENT

Figure 1:
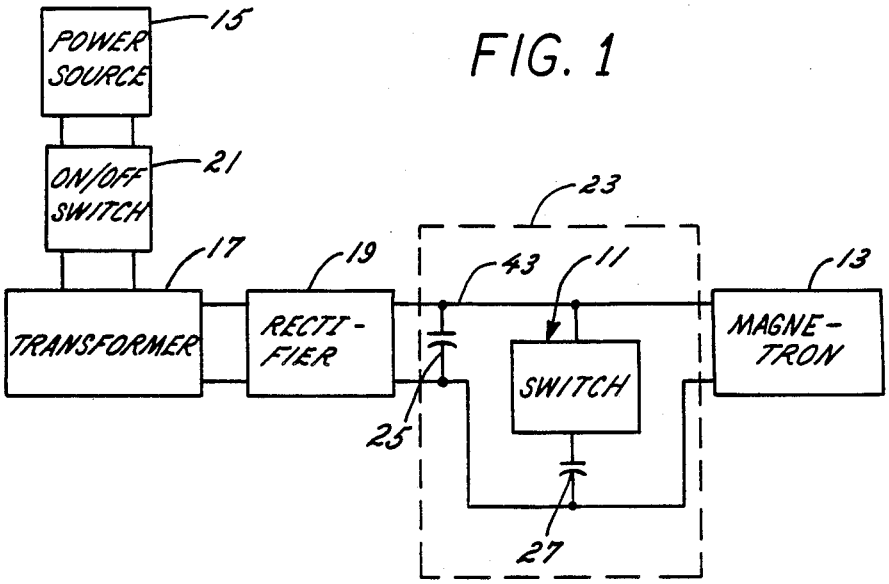
FIG. 1 is a schematic drawing of an exemplary environment incorporating the present invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to FIG. 1, there is shown an electronic system for a microwave oven incorporating a high-voltage switch 11 embodying the present invention. In a conventional manner, a magnetron 13 is excited by energy delivered from a power source 15. In some countries such as the United States, the power source 15 is typically AC power at 60 Hz. Many other countries, however, provide AC power at 50 Hz. To excite the magnetron 13, the 50 or 60 Hz AC power is first converted to a very high voltage at a transformer 17. From the transformer 17, the high AC voltage is rectified in a rectifier 19 in order to provide a very high DC voltage (e.g., 8,000 volts). Of course, a manually actuatable on/off switch 21 controls the application of power to the magnetron 13.

Because the magnetron 13 is highly sensitive to any AC component (i.e., ripple voltage) in the DC voltage from the rectifier 19, a filter network 23 shown as capacitors 25 and 27 is typically placed between the rectifier and the magnetron. Component values for the filter network 23 are chosen to best deal with the ripple voltage superimposed on the DC voltage and resulting from the alternating nature of the power source 15. Because the ripple voltage results from the alternating nature of the power source 15, it is characterized by the same frequency as that of the power source—e.g., 50 or 60 Hz.

Instead of customizing the filter network for either 50 or 60 Hz ripple and thereby requiring two microwave systems—one for the 60 Hz countries and another for the 50 Hz countries—the high-voltage switch 11 of the invention allows the filter network to be tuned to best handle either 50 or 60 Hz ripple. The tuning is accomplished simply by inserting or removing a tuning element such as the capacitor 27 into or out of the filter network 23. Therefore, the high-voltage switch 11 has two states. Depending upon whether the microwave oven is intended for a market having 60 or 50 Hz power, the product preparation includes placing the switch 11 in a first state shown in FIG. 1 or in a second state which connects capacitor 27 to the filter network 23.

Figure 2:
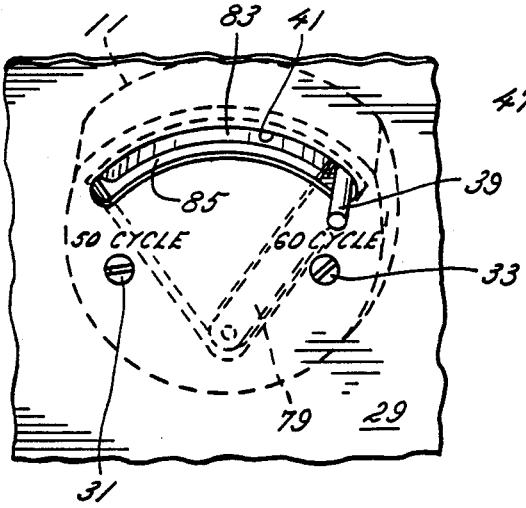
FIG. 2 is a fragmentary and perspective front view of a plate upon which the high-voltage switch of the present invention is mounted.
Figure 3:
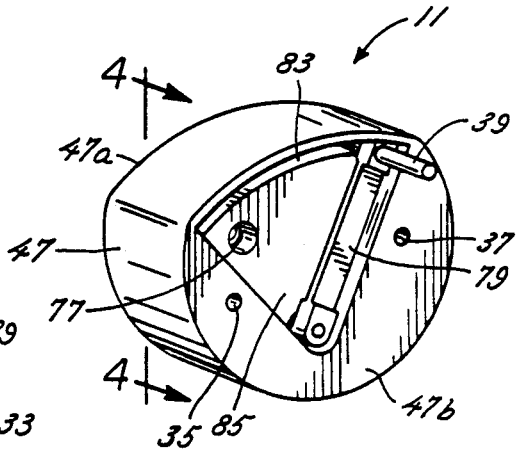
FIG. 3 is an elevated perspective view of the front of a high-voltage switch according to the present invention.
Figure 4:
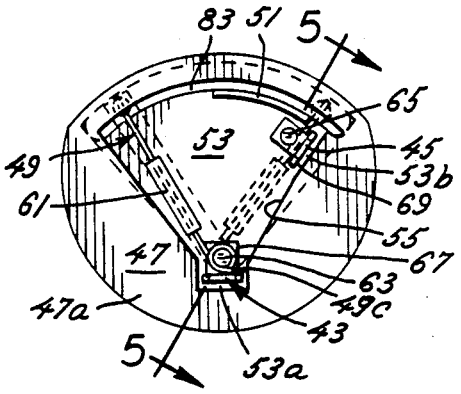
FIG. 4 is a rear plan view of the high-voltage switch shown in FIG. 3, taken along the line 4—4 in FIG. 3, showing alternate first and second positions of a pivotable wiper arm assembly in solid and dashed lines, respectively.

Preferably, the switch 11 is isolated from direct touch by a barrier such as a panel 29 shown in FIG. 2. The switch 11 is mounted to the panel by a pair of self-tapping screws 31 and 33 which mate with holes 35 and 37 (see FIG. 3). In order to operate the switch 11, a handle member 39 extends through an arcuate slot 41 in the panel 29. In preparing the microwave to be sold into a 60-Hz market, the handle member 39 is moved to the end of the arcuate slot 41 marked as "60 cycle" as illustrated in FIG. 2. For a 50-Hz market, the handle member 39 is moved to the end of the arcuate slot 41 marked "50 cycle." As explained hereinafter in greater detail, movement of the handle member 39 from one end of the arcuate slot 41 to the other transfers the switch 11 from one state to another. In a first state, the high voltage on line 81 in FIG. 1 is connected to the capacitor 27. In a second state, the high voltage on line 81 is isolated from the capacitor 27.

The high-voltage switch of the invention provides the manufacturer with a simple, inexpensive and easily implemented method for manufacturing only one magnetron circuit for both 50 and 60 Hz markets. Preferably, access to the handle member 39 of the switch 11 is only by way of removing the back panel (not shown) of the microwave oven. Therefore, once the switch 11 has been placed in either its 50 or 60 Hz state and the back cover secured, the filter network 23 is fixed to match the intended frequency of the power source 15 and the state of the switch cannot be thereafter changed without removal of the back panel, and such removal should not occur except for authorized servicing of the oven.

In accordance with one important aspect of the invention, the switch assembly comprises a base member of insulating material for supporting primary and secondary terminal assemblies and a manually pivotable conductive rod for selectively coupling the terminals in a manner that allows a high electrical potential to be transferred from one terminal assembly to the other. The base member provides an insulating support surface for the conductive rod and terminal assemblies such that arcing between terminal assemblies and the conductive rod are avoided. In addition, the base member also prevents arcing to ambient conductors such as the panel 29. Preferably, the base member is a monolithic block of nylon formed by conventional injection molding techniques. Because the base member isolates the conductive surfaces of the switch from one another and from other conductive surfaces in the ambient environment, a separate insulating housing is not needed. Accordingly, the switch is simple in structure in relation to other the high-voltage switches and, therefore, relatively inexpensive to manufacture.

Referring now to the illustrated embodiment of the high-voltage switch assembly of the present invention shown in FIGS. 2 through 6, primary and secondary terminals 43 and 45, respectively, are mounted to a base member 47 which is preferably a monolithic block of an insulating material such as nylon, having first and second planar sides 47*a* and 47*b*, respectively. The terminal assemblies 43 and 45 are mounted to the first side 47*a*.

To alternately connect and disconnect the primary and secondary terminals 43 and 45 so as to provide the switching function, a conductive rod 49 is coiled about the primary terminal 43, with a first end 49*a* diverging from a coiled path and extending radially outward from an axis of the coil 49*b* formed by the rod. This first end 49*a* of the rod 49 is sufficient long such that it spans the distance between the primary and secondary terminal assemblies 43 and 45. To define the alternative states of the switch assembly, a second end 49*c* of the conductive rod 49 diverges from the coil 49*b* and is in fixed relationship with the primary terminal assembly 43 such that the pivoting of the first end 49*a* creates a torsional force at the coil 49*b* of the rod 49 which tends to bias the first end 49*a* away from the secondary terminal assembly 45. To close the switch, this biasing force is easily overcome by the force of a human hand without the need for additional leverage devices.

In order to secure the first end 49*a* of the conductive rod 49 into a direct contact relationship with the secondary terminal assembly 45, the first end is first pivoted against the torsional force of the coil 49*b* past the assembly 45. Because the secondary assembly 45 extends into the natural plane of rotation for the first end 49*a* , a flange 51 extending from the surface of the base member 47 and into the natural plane of the rod's rotation causes the end 49*a* to bend outwardly from the base member and thereby pass over the secondary terminal assembly. The flange 51 extends along an arc of the rod rotation and at a radius beyond the secondary terminal assembly 45. To ease the outward bending of the rod 49, the flange 51 is tapered to form a gradual transition from a planar surface area of the base member 47 when considered during movement of the rod from its rest position to its engaged position (left to right in FIG. 4). Once the first end 49*a* of the rod 49 is pivoted past the secondary terminal assembly 45, the flange 51 ends and the rod is free to return to the plane of its natural rotation. Because the secondary terminal assembly 45 extends into this plane of rotation, it blocks the return of the rod 49 to its rest position. The torsional force of the coil 49*b* biases the first end 49*a* of the rod against the secondary terminal assembly 45, thereby ensuring positive electrical contact.

To disengage the first end rod 49*a* of the conductive rod from the secondary terminal assembly 45, the first end is drawn out of its plane of rotation by a manually applied force. With the first end 49*a* extending sufficiently out of its normal plane of rotation, the torsional force of the coil 49*b* will direct the first end over the top of the secondary terminal assembly 45, thereby freeing the rod from contact with the terminal. After it is free from contact with the secondary terminal assembly 45, the first end 49*a* of the coil pivots in response to the torque of the coil 49*b* to a rest position shown in FIG. 4.

Because the switch is without an insulating housing, the terminal assemblies 43 and 45 and the conductive rod 49 must be sufficiently spaced from any conductive elements in the ambient environment so as to ensure arcing does not occur. Obviously, the careful placement of conductive surfaces in a general area of the switch is a design consideration which can greatly reduce the possibility of arcing. To further ensure arcing is not a problem, the terminal assemblies 43 and 45 and conductive rod 49 are placed in a recess 53 of the base member 47 so that the terminal assemblies and rod are effectively surrounded by an insulating wall. In order to aid in preventing arcing to conductive elements positioned generally above the terminal assemblies 43 and 45, a sufficient air gap between the elements and assemblies must be present. Preferably, the wall 55 of the recess 53 is of a slightly greater height as measured from the base of the recess than are the upstanding portions of the terminal assemblies 43 and 45. Therefore, there is no conductive surface which extends beyond the first side 47*a* of the base member 47. In order to accommodate the pivoting of the conductive rod 49, the recess 53 is generally fanshaped, having a planar surface. Extensions 53*a* and 53*b* of the fan shape provide for the easy assembly of the terminal assemblies 43 and 45 during the manufacturing process.

The precise dimensions of the base member, for example, the depth of the recess 53 and the distance between bores 57 and 59 are dependent upon the anticipated voltage of the circuit into which the invention will be placed. As a general rule, for each 100 volts of power, a corresponding air gap of 1/1000ths of an inch is required in order to prevent arcing.

An insulating sleeve 61 is fitted over the conductive rod 49 to prevent arcing from occurring between the secondary terminal assembly 45 and the conductive rod 49 if extreme ambient conditions are present such as very high humidity. The sleeve 61 should cover the area of the first end 49*a* which is closest to the secondary terminal assembly 45. Geometrically, the closest surface of the rod 49 is where a line connecting the assembly and rod forms a perpendicular at the rod.

In keeping with the invention, the second side 47*b* of the base member 47 is mounted to the panel 29 so that the insulating material of base member isolates the high voltage at the terminal assemblies 43 and 45 from the panel which is typically made of metal. To manually access the conductive rod 49 and thereby operate the switch when the base member 47 is mounted to the panel 29, an arcuate slot 83 is cut into the member which communicates the first and second sides 47*a* and 47*b*, respectively. The general shape of the slot 83 corresponds to an arc of a circle traced by the rod 49 at a radius approximately equal to the length of the first end 49*a* of the rod. The handle 31 is of insulating material preferably the same material which comprises the base member and is fitted over the tip of the first end 49*a* of the rod. It extends through the slot 83 of the base member and the slot 41 of the panel 29. The slot 41 is shaped to complement the shape of slot 83. With the foregoing structure and mounting, the switch 11 is electrically isolated from the panel 29 without the need of a housing. At the same time, the switch assembly 11 can be easily operated from its second side 49*b* which is directly mounted to the panel 29.

Terminal assemblies 43 and 45 comprise conductive posts 63 and 65 and terminals 67 and 69, respectively. The latter are used to secure wire leads to the switch assembly 11. The posts 63 and 65 are cylindrical conductors projecting from the base of the recess 53 and held to the base member 47 by rivets 71 and 73. The rivets 71 and 73 are joined to the posts 63 and 65 through bores 75 and 77 in the base member 47. The bores 75 and 77 extend transversely through the base member 47 and communicate the first and second sides 47*a* and 47*b*, respectively, of the base member. In order to ensure the rivets 71 and 73 do not allow arcing of the high voltage to the panel 29, the bores 75 and 77 are characterized by dual diameters. In the smaller diameter of each bore, the rivet and post are mated. The larger diameters or recesses of the bores 75 and 77 serve to recess heads 71*a* and 73*a* of the rivets 71 and 73, respectively. The recess provides a spaced relationship between the heads 71*a* and 73*a* of the rivets and the panel 29 that ensures arcing will not occur. For additional protection, however, an insulating coating (not shown) is preferably placed over the rivet head 73*a* in order to prevent arcing to the mounting panel 29. As for the head 71*a* of rivet 71, its recess serves as a pivot base for a wiper arm 79 as discussed hereinafter.

Figure 5:
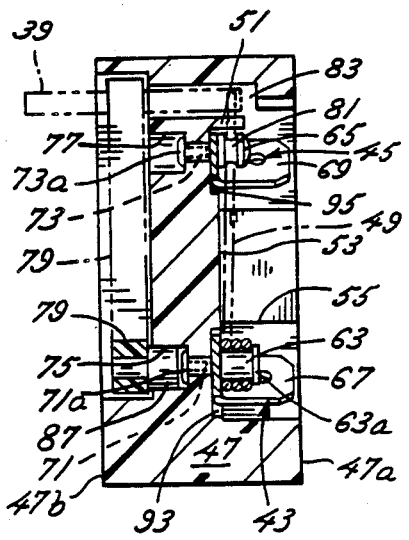
FIG. 5 is a vertical section of the high-voltage switch, taken along the plane of line 5—5 in FIG. 4.
Figure 6:
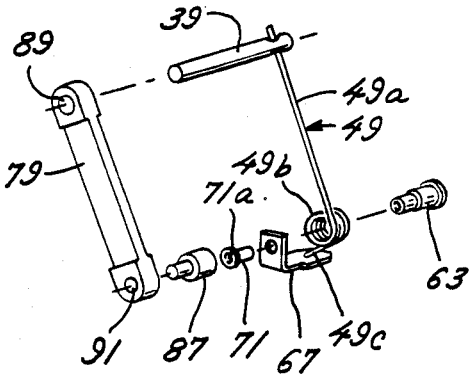
FIG. 6 is a fragmentary and perspective view of the pivotable wiper arm assembly, including a conductive rod for making an electrical connection between primary and secondary terminal assemblies of the switch.

As best seen in FIG. 5, conductive posts 63 and 65 are shaped to best serve their particular functions. Specifically, conductive post 65 includes a concave-shaped recess 81, allowing for retention of the conductive rod 49 when placed in its closed position. This concave-shape of the conductive post 65 serves to retain the rod 49 in positive electrical contact with the post and prevent an accidental recoiling of the rod to its open position. In order to retain the coiled portion of the rod 49, the conductive post 63 includes a flange 63*a*. To create and maintain good electrical contact between the posts 63 and 65 and the rod 49, both the posts and rod are plated with silver (e.g., 0.0002–0.0004 inches). Preferably, both posts 63 and 65 are made of brass, and the conductive rod is made of a phosphor bronze.

In order to manually pivot the rod 49 when the second side 47*b* of the base member 47 is mounted to the panel 29, the cylindrical handle member 39 is secured to the first end 49*a* of the rod 49 and extends through the arcuate slot 83 in the base member 47 so that an end of the handle can be grasped from the second side of the base member. By grasping the handle 39 and sliding it along the length of the slot 83, the first end 47*a* of the conductive rod 47 may be moved into or out of contact with the secondary terminal assembly 45 as previously described. To stabilize the handle 39 and maintain it in transverse relation to the first and second sides 47*a* and 47*b* of the base member 47 during traversal of the slot 83, the handle is secured to one end of the wiper arm 79 which is mounted for pivoting on the second side of the base member. The wiper arm 79 pivots about an axis which is coincident with the axis of the coil 49*b* of the conductive rod 49, thereby allowing the slot 83 to define an arc of a circle whose center is coincident with the wiper arm and coil axes. Such a construction allows the first end 49*a* of the rod 49, the handle 39 and the wiper arm 79 to move together without binding.

To provide the second side 47*b* of the base member 47 with a flush surface for easy mounting to panel 29, a fan-shaped recess 85 in the second side receives the wiper arm 79. The recess 85 is sufficient to ensure the surface of the wiper arm is below or in plane with the planar surface of the second side 47*b*. To pivot about an axis which is coincident with the axis of the coil 49*b* of the conductive rod 49, a pivot boss 87 extends from the body of the wiper arm 79. The pivot boss 87 is received by the larger diameter portion of the bore 75 so that the bore effectively serves as a pivot socket for the wiper arm 79. Preferably, the wiper arm 79, handle member 39 ,and pivot boss 87 are press fitted into the wiper arm by way of bores 89 and 91 so as to form a wiper arm assembly. Like the base member 47, the wiper arm assembly is made of insulating material such as nylon and formed by conventional injection molding techniques. Because the pivot boss 87 is received by the bore 75, it provides insulating protection to the rivet 71 and an insulating coating such as provided rivet 73 is unnecessary.

To prevent the terminals 67 and 69 from turning about the generally cylindrical shapes of the conductive posts 63 and 65, respectively, the recess 53 includes seats 93 and 95 which receive the terminals and whose walls prevent the terminals 67 and 69 from rotating. The terminals 67 and 69 are conventional L-shaped terminals having holes for receiving wire conductors. Either the primary or secondary terminal assembly may serve as the terminal connected to the high voltage. As previously mentioned, the second end 49*c* of the conductive rod 49 is held in a fixed relationship with the terminal assembly 43. To accomplish this fixed relationship, the upstanding portion of the terminal 67 is spaced from the conductive rod 49 so that the second end 49*c* of the rod cannot be rotated through the space separating the rod and the upstanding portion of the terminal.

From the foregoing, it will be appreciated that the switch assembly of the invention provides access to the conductive rod 49 from the second side 47*b* of the base member 47 while maintaining electrical isolation of the terminal assemblies and rod from the panel 29 and other ambient conductors. This result is achieved without the need for an insulating housing. Furthermore, the mechanical linkage required to provide access to the rod 49 is minimal and inexpensive in design; yet, the switch is relatively rugged and highly reliable.

I claim:

1. In a high-voltage circuit, a switch assembly for alternatively introducing or removing an element into or from said high-voltage circuit, said switch comprising in combination a base member of insulating material, said base member having first and second sides, primary and secondary terminal assemblies mounted to said first side and separated by a first predetermined distance, a conductive rod wrapped around a post of said primary terminal assembly so as to form a coil, one end of said conductive rod diverging from said coil and extending a sufficient length to span said first predetermined distance, said one end of said conductive rod is pivotable about an axis of said coil between a first position where said one end is separated from said secondary terminal assembly and a second position where said one end is in direct contact with said secondary terminal assembly, means for pivoting said one end between said first and second positions comprising (1) a pivotable wiper arm mounted on said second side of said base member for the pivoting about an axis of said coil and (2) a slot in said base member for receiving a handle extension of said pivotable wiper arm which spans said slot and joins to said one end of said conductive rod such that the pivoting of said pivotable wiper arm moves said one end of said conductive rod between said first and said second positions.

2. A switch as set forth in claim 1 including a recessed area on said first side of said base member for spatially separating said primary and secondary terminal assemblies and said conductive rod from conductive surfaces in the ambient environment of said switch.

3. A switch assembly as set forth in claim 1 wherein said second side of said base member is mated to a panel having a slot of substantially the same size and shape as said slot of said base member such that said handle extension of said wiper arm is accessible through said slot in said panel.

4. A switch as set forth in claim 3 wherein said second side of said base member is recessed in an area covered by the pivoting of said wiper arm such that said wiper arm may be freely pivoted while the second side is mated to said panel.

5. A switch assembly as set forth in claim 1 wherein a torsional force from said coil biases said first end of said conductive rod away from said second position and toward said first position, said switch assembly including:

means for locking said first end in said second position and utilizing said torsional force to maintain a positive electrical contact between said first end and said secondary terminal assembly.

6. A switch assembly as set forth in claim 5 wherein said locking means includes a flange of said base member which cooperates with said first end of said conductive rod during the pivoting of said first end from said first position to said second position so as to force said first end out of its natural plane of rotation.

7. A high-voltage switch assembly comprising:

a base, member of insulating material having first and second sides;

primary and secondary terminal assemblies mounted to said first side of said base member and separated by a first distance;

conductive means mounted to said primary terminal assembly for pivoting about a first axis for transferring a high voltage between said primary and secondary terminal assemblies;

a wiper arm assembly of insulating material mounted to said second side of said base member for pivoting about said first axis;

a slot communicating said first and second sides; and said wiper arm assembly including a handle portion which passes through said slot and is coupled to said conductive means such that manual pivoting of said handle portion pivots said wiper arm assembly and said conductive means about said first axis.

8. A high-voltage switch assembly as set forth in claim 7 wherein said conductive means is a rod having a coiled portion wrapped about said primary terminal assembly and a first end diverging from said coiled portion and extending to a length which spans said first distance.

9. A high-voltage switch assembly as set forth in claim 8 wherein said coiled portion of said rod defines a coil whose axis is coincident with said first axis.

10. A high-voltage switch as set forth in claim 7 wherein said second side of said base member is mated to a panel having a slotted opening which complements said slot communicating said first and second sides of said base member such that said handle portion extends through said slotted opening.

11. A high-voltage switch as set forth in claim 8 including means for locking said first end of said rod to said secondary terminal assembly.

12. A high-voltage switch as set forth in claim 11 wherein said locking means includes a flange of said base member for directing said first end of said rod out of its natural plane of rotation.

13. A high-voltage switch as set forth in claim 8 wherein said first and second sides of said base member are recessed in order to receive said conductive rod and said wiper arm assembly, respectively, and said recesses having fan-like shapes in order to accommodate the pivoting of said conductive rod and said wiper arm assembly.

14. A high-voltage switch as set forth in claim 7 wherein each of said primary and secondary terminal assemblies comprises a conductive post of a generally cylindrical shape and an L-shaped terminal for receiving a lead wire.

15. A high-voltage switch as set forth in claim 14 wherein said conductive post is received by a bore communicating said first and second sides of said base member and retained in said bore by a mating rivet which is inserted into said bore by way of said second side.

* * * * *